US010167642B2

(12) United States Patent
Thompson

(10) Patent No.: US 10,167,642 B2
(45) Date of Patent: Jan. 1, 2019

(54) DUAL PLATFORM FOR A COMPOSITE POWER POLE

(71) Applicant: Bruce Thompson, Oak Hills, CA (US)

(72) Inventor: Bruce Thompson, Oak Hills, CA (US)

( * ) Notice: Subject to any disclaimer, the term of this patent is extended or adjusted under 35 U.S.C. 154(b) by 0 days.

(21) Appl. No.: 15/224,908

(22) Filed: Aug. 1, 2016

(65) Prior Publication Data

US 2018/0030743 A1 Feb. 1, 2018

(51) Int. Cl.
*E04G 3/24* (2006.01)
*E04G 5/04* (2006.01)

(52) U.S. Cl.
CPC ..... *E04G 3/24* (2013.01); *E04G 5/045* (2013.01)

(58) Field of Classification Search
CPC ..... E04G 3/24; E04G 5/045; A01M 31/02; A01M 31/025; A45F 3/26
See application file for complete search history.

(56) References Cited

U.S. PATENT DOCUMENTS 1,250,699 A 12/1917 Sturgel
2,060,953 A 11/1936 Strom
2,742,217 A * 4/1956 Maxwell ..... A01D 46/243 182/108
2,855,980 A * 10/1958 Konieczka ..... A01M 31/02 182/187
2,982,337 A 5/1961 Arena
3,497,033 A * 2/1970 Herrenkohl ..... A63B 27/00 182/92
3,817,350 A * 6/1974 Gray ..... A01M 31/02 182/187
4,009,763 A * 3/1977 Hunter ..... E04G 3/24 182/187
4,129,198 A 12/1978 Hunter
4,244,445 A * 1/1981 Strode ..... A45F 3/26 182/136
4,310,070 A * 1/1982 Mastrogiannis ..... A63B 27/00 182/134
4,382,488 A * 5/1983 Anderson ..... B66F 1/02 182/132
4,583,618 A * 4/1986 Zimmerman ..... E04G 1/20 182/119
5,105,910 A * 4/1992 Engstrom ..... A01M 31/02 182/152

(Continued)

*Primary Examiner* — Katherine W Mitchell
*Assistant Examiner* — Candace L Bradford
(74) *Attorney, Agent, or Firm* — Kirk A. Buhler; Buhler & Associates

(57) ABSTRACT

Improvements in a dual platform for a composite power pole is disclosed. The platform. The stepup is a two-tiered aerial working platform that be attached to an upright member such as an electrical power pole, it can be mounted at any put the lineman or worker in the best possible working position and allows a lineman to step up or down in a manner that they are accustomed. The dual platform wraps partially around the pole so a worker can safely step around pole without fear of a misstep. The platforms exist at a neutral angle to increase standing comfort. The platforms are nestable whereby platforms can be strapped to opposite sides of pole. This allows a worker to install multiple platforms to make a ladder to climb the pole or to create a platform around the circumference of the pole or a circumferential staircase.

20 Claims, 4 Drawing Sheets

(56) References Cited

U.S. PATENT DOCUMENTS

| | | | | |
|---|---|---|---|---|
| 5,848,666 | A * | 12/1998 | Woodall | A01M 31/02 182/187 |
| 5,941,485 | A * | 8/1999 | Davidson | E04H 12/08 248/218.4 |
| 6,484,981 | B1 * | 11/2002 | Perrault | A63B 27/00 182/92 |
| 6,666,456 | B1 * | 12/2003 | Swankie | E06C 1/34 182/189 |
| 7,124,699 | B1 * | 10/2006 | Clark | E02B 3/20 114/218 |
| 9,057,202 | B2 | 6/2015 | Berkbuegler | |
| 9,631,428 | B2 * | 4/2017 | Niemela | E06C 1/381 |
| 2005/0111929 | A1 * | 5/2005 | Tessier | B60P 7/083 410/100 |
| 2007/0209410 | A1 * | 9/2007 | Clum | A01M 31/02 70/262 |
| 2012/0174498 | A1 * | 7/2012 | Anderson, Jr. | A01M 29/32 52/101 |
| 2012/0211306 | A1 * | 8/2012 | Benefield | E06C 7/16 182/115 |
| 2014/0190767 | A1 * | 7/2014 | Wheelington | A01M 31/02 182/129 |
| 2015/0252616 | A1 * | 9/2015 | Collyer | A01M 31/025 182/115 |

* cited by examiner

DUAL PLATFORM FOR A COMPOSITE POWER POLE

CROSS REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a dual platform for a composite power pole. More particularly, the present plat for can be installed on a power pole and allows a worker to stand on either step of the pole platform to work around the pole and step between the platforms.

Description of Related Art Including Information Disclosed Under 37 CFR 1.97 and 1.98

When working on power or telephone poles, a worker typically climbs the pole with a belt and climbers. Once the worker is at the desired height they typically stand at the elevation while they work. If they must remain at the elevation for an extended period of time the side loading from the hooks/climbers can become uncomfortable. Stands and ledges for poles and trees are common with hunters that can remain at an elevated position for hours are common.

Tree stands are used for supporting hunters, photographers, and nature enthusiasts at an elevated position in a tree to watch for game or observe wildlife. At that position, the view of the surrounding terrain is increased, a field of aim is improved, and the user is less likely to be seen by wildlife. It can be difficult to attach a stand to a tree or pole. The user must, while holding the platform in position adjacent to a tree or pole, move a chain, yoke or strap around a back side of the trunk or pole, secure and tighten it firmly against the tree or pole. These tasks are cumbersome for the user because one hand is occupied supporting the platform. These tasks are potentially hazardous, and many users have inadvertently fallen and received injury.

A number of patents and or publications have been made to address these issues. Exemplary examples of patents and or publication that try to address this/these problem(s) are identified and discussed below.

U.S. Pat. No. 2,982,337 issued on May 2, 1961 to J. E. Arena disclose a Tree Seat. The tree seat provides an elevated platform and foot rest for a hunter. While the tree seat provides some comfort for a hunter, the seat provides only a single position for a worker and the worker can't walk around a platform to work.

U.S. Pat. No. 3,817,350 issued on Jun. 18, 1974 to Zane P. Gray and discloses a Portable Sportman Seat. The body supporting seat, has a foot support connected to the forward edge of the seat to support the feet of the user, a first support frame hinged at a lower end along the back edge of the seat for engaging the surface of a tree trunk or other supporting column, a second support frame pivoted at an upper end with the upper end of the first support frame and extending downwardly and outwardly at an angle with a lower end selectively engageable in selected pairs of slots of the seat for supporting the seat at a desired angle disclose. The seat is essentially just a platform and extends from the trunk or pole in only one direction thereby limiting the ability of a worker to walk around the platform.

U.S. Pat. No. 4,009,763 issued on Mar. 1, 1977 to Alex E. Hunter discloses a pole ladder. The collapsible pole ladder is for suspension on a pole, securely in place, by the mere stepping on the platform or treads which effects insertion of cleats into the pole. A chain, which surrounds the pole for supporting the ladder, is tightly gripped around the pole by turning a swivelly mounted tightening screw. This pole ladder also only extends from the pole in a single direction and requires multiple chains to be strung around the pole.

U.S. Pat. No. 4,129,198 issued on Dec. 12, 1978 to Alex E. Hunter discloses a Pole Seat and Ladder. The seat is supported on a carriage and is selectively moveable to different positions along a horizontal frame to selectively position the worker closer to or away from the pole. A ladder element is so connected as to enable foot support by the worker and which is also collapsible. The seat places a worker facing the pole and limits their ability to be supported around the pole.

What is needed is a dual platform for a composite power pole that allows a worker to stand at nearly any position around the pole and further provides a second step so the worker can step up or down to obtain the optimal working height as they complete a task or installation. The proposed dual platform for a composite power pole provides the solution.

BRIEF SUMMARY OF THE INVENTION

It is an object of the dual platform for a composite power pole to be mounted to a wood or composite power pole or tree. The "2 Step" is a two-tiered aerial working platform that be attached to an upright member such as an electrical power pole, it can be mounted at any put the lineman or worker in the best possible working position.

It is an object of the dual platform for a composite power pole to have two steps. The two steps are separated at the same distance as the rungs on a ladder. Using the common step height of a ladder allows a lineman to step up or down in a manner that they are accustomed.

It is another object of the dual platform for a composite power pole to provide platforms that wrap nearly completely around the pole. Because the dual platform wraps over 180 degrees around a pole and about 270 degrees around its own central structure a worker can safely step around pole without fear of a misstep.

It is another object of the dual platform for a composite power pole for the platform to exist at a neutral angle for a user on a pole. The neutral angle reduces stresses on the feet and ankle of the worker to increase their comfort and allows them to work for a longer period of time.

It is another object of the dual platform for a composite power pole to include a ring for lifting the platform from the ground or from another elevation. A lineman can climb a pole and then utilize a rope or similar mechanism to pull the platform to their location when they are ready to work. After the work is complete the lineman can use the ring to lower the platform to the ground.

It is another object of the dual platform for a composite power pole for the platforms to be nestable whereby platforms can be secured to opposite sides of pole. This allows a worker to install multiple dual platforms to make a ladder to climb the pole or to allow the worker to create a platform around the circumference of the pole.

It is still another object of the dual platform for a composite power pole to be securable on a pole with a strap. The strap can be quickly extended around the pole and tightened to secure the dual platform. The strap can be quickly released to allow the dual platform to be reused or installed at a different elevation on the pole.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
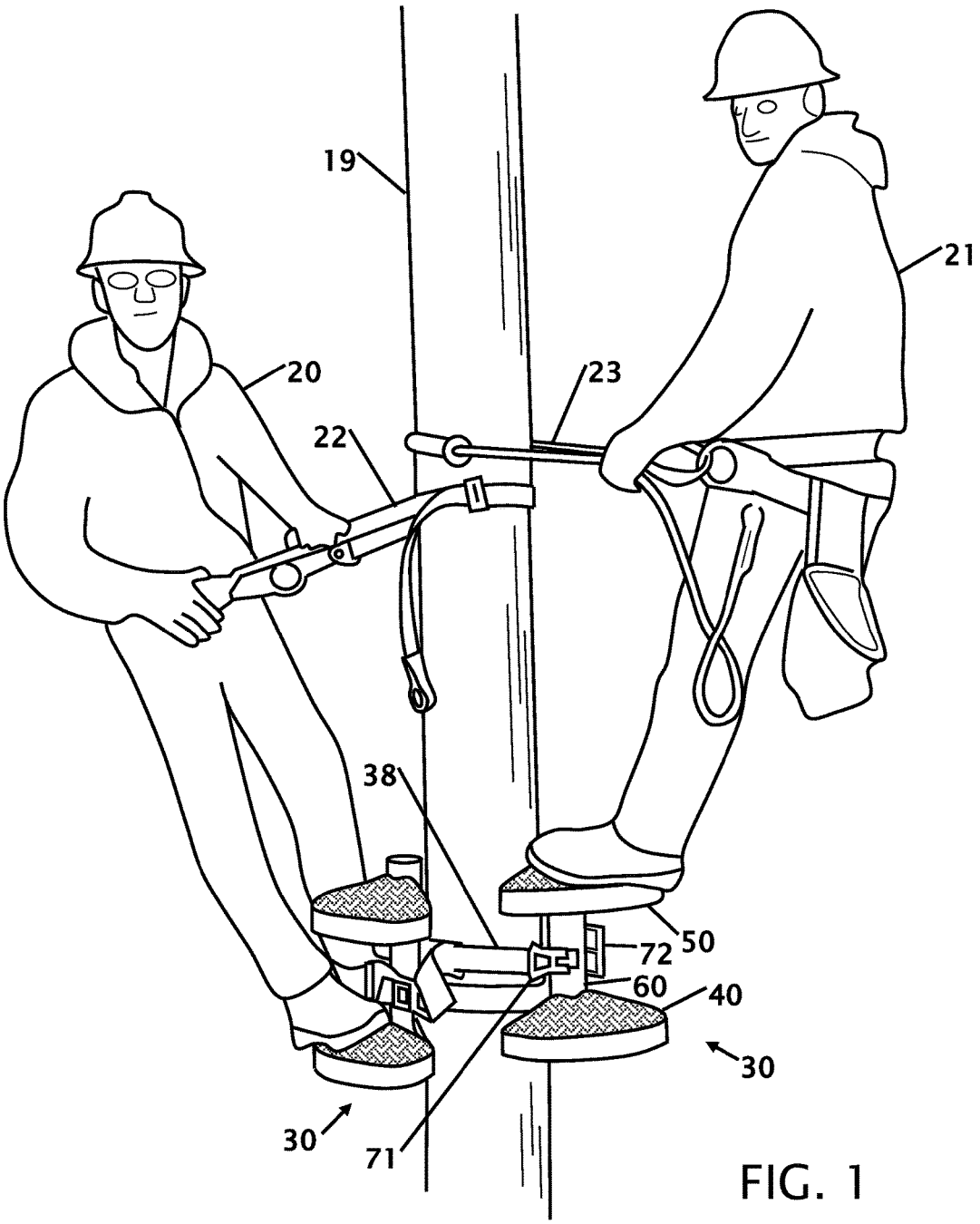
FIG. 1 shows two dual platforms for a composite power pole in an environment of use.

FIG. 1 shows two dual platforms for a composite power pole in an environment of use. The dual platform is a two-tiered aerial platform 30 that attaches to a composite pole 19, wood steel, or concrete pole or any upright elongated member. The unique design makes it easy to attach and then climb past it to work off of. The 2 tiers 40 and 50 make it possible to work at multiple levels without having to relocate the device. Every Lineman 20, 21 or worker is a different height, the 2 allows the Lineman or worker to mount it at the optimum level for him to reach everything that needs to be worked upon. It allows the worker 20, 21 to work from the platform 40, 50 at the height that works best without having to work from the pole steps that may or may not be in the correct place to complete the work. It also gets the workers off of the steps where they would be stepping on each other's feet and onto a comfortable platform where it is less stress on their feet and body.

The dual platform 30 is the solution to working from a composite, wood, steel, or concrete pole when a bucket "Man Lift" is not available or has no access. It attaches with a heavy duty ratchet strap and locking buckle in about 10 seconds after the worker gets his or her hands on it. The 2 Step has 2 non slip platforms to work off of, it is currently made of Aluminum, but could be made of steel, chrome moly, stainless steel, aluminum, fiberglass, plastic, bronze, copper, or even 3D printed. The 2 Step 30 can be mounted on both sides of the pole as shown in this figure at the same approximate level allowing 2 workers 20, 21 to work both sides of the pole 19 and still be able to climb past it while remaining belted 22, 23 off around the pole 19. Each worker 20, 21 can mount it at their optimum height to reach the work comfortably. The 2 levels 40, 50 are approximately 12 inches apart to be about the same spacing as the rungs on a ladder, so relocating from the lower level to the upper level is done with ease and without having to look.

The 2 step is a working platform 30 that is designed to stand on while working on any type of pole. The "2 step" or stepup is attached to the pole to be worked on by a 2" nylon ratchet strap 38 rated at 3300 lbs. The "2 step" has been engineered for a safe working load of 360 pounds on either level. There are no sharp edges or anything that could injure worker when climbing past it after is has been mounted. The strap 38 is held onto the 2 step with ⅜" and a ½" bolt, that is bolted to a solid piece that goes thru the center of the pipe 60 that the 2 platforms are welded too. Strapping material is coupled 71 and tightened with a ratcheted 72 or similar strap tightening mechanism that pulls the center pipe 60 to the pole 19.

Figure 3:
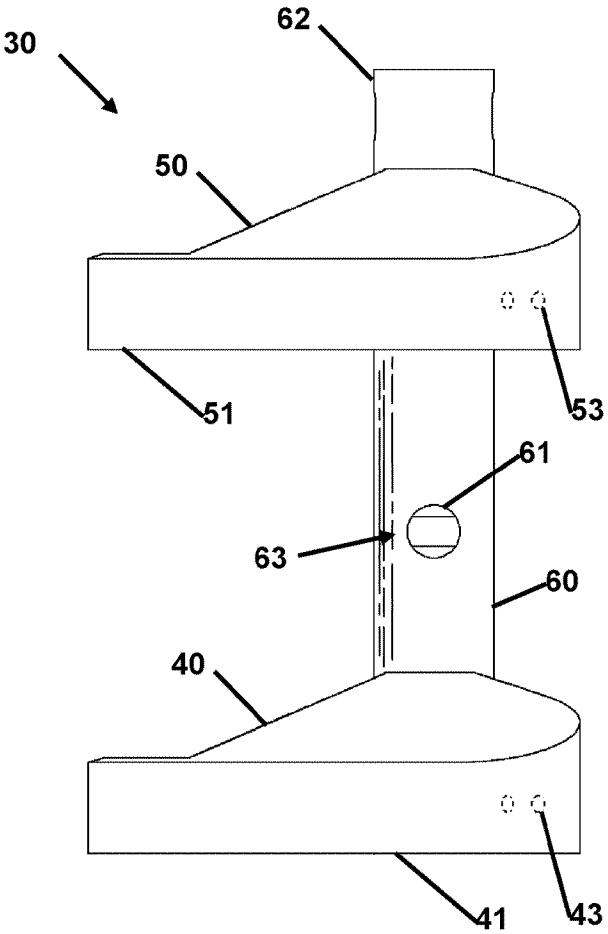
FIG. 3 shows a side view of the dual platform.
Figure 2:
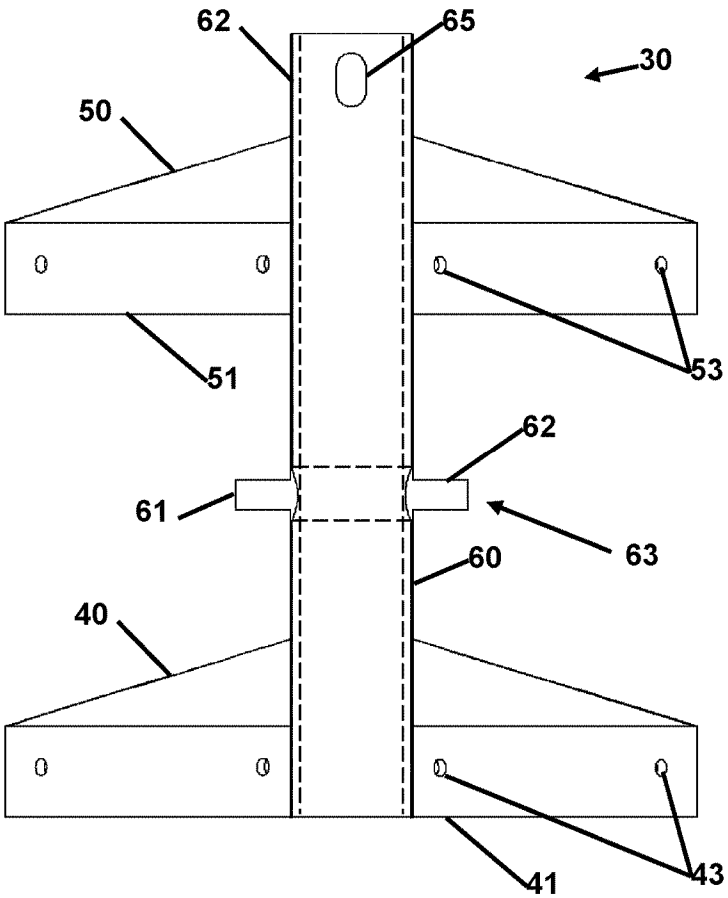
FIG. 2 shows a rear view of the dual platform.

FIG. 2 shows a rear view of the dual platform and FIG. 3 shows a side view of the dual platform. The 2 step is a working platform 30 that is designed to stand on while working on any type of pole. The "2 step" is attached to the pole to be worked on by a 2" nylon ratchet strap 38 rated at 3300 lbs. The "2 step" has been engineered for a safe working load of 360 pounds on either level. There are no sharp edges or anything that could injure worker when climbing past it after is has been mounted. The strap 38 is held onto the 2 step with ⅜" and a ½" bolt, that is bolted to a solid piece that goes thru the center of the pipe that the two platforms are welded. Each platform 40 and 50 is curved to wrap, at least partially around the central pipe 60. A support ring or arc 41, 51 provides a vertical support for each platform 40, 50. The bottom on the steps 41 and 51 is essentially flat. The central pipe 60 extends above 62 the upper support platform 50.

There is an oval shaped hole 65 in the upright pipe 62 to place a hand line hook into the hole 65 to send the dual platform 30 up to the worker, the person on the ground can hold the weight of the 2 step, about 18 pounds, while the aerial worker attaches it to the pole to be worked. The center of the pipe 60 has a horizontal stud 63 that extends out of both sides 61, 62 of the pipe 60. The stud 63 allows for securing a strap to the sides 61 and 62 and then around a power pole. Tightening a strap 38 (not shown in this figure) that pulls the dual platform 30 to the power pole. A plurality of holes 43, 53 allow for securing a pad to increase friction of the dual platform 30 against a power pole and also prevents damage to the power pole.

Figure 5:
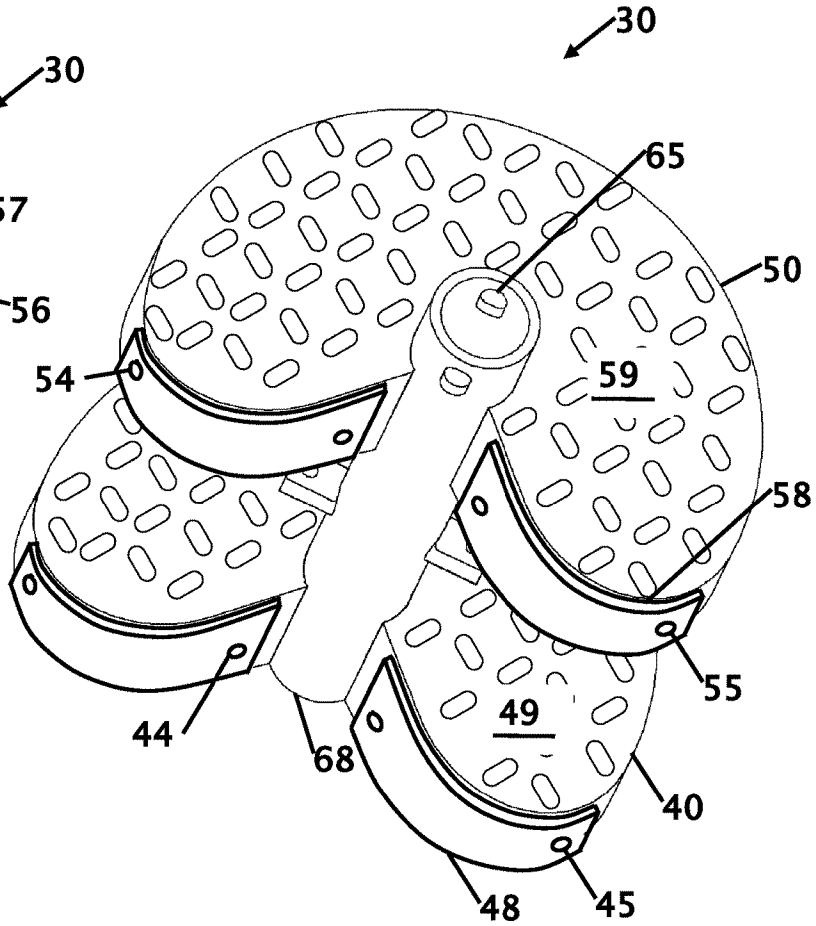
FIG. 5 shows a top side view of the dual platform.
Figure 4:
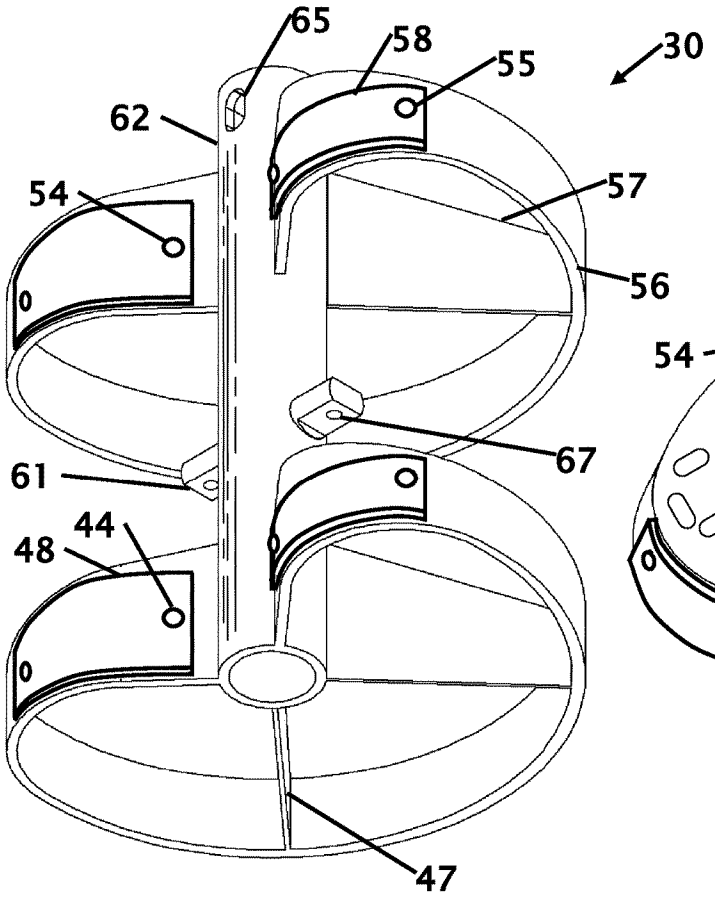
FIG. 4 shows an underside perspective view of the dual platform.

FIG. 4 shows an underside perspective view of the dual platform 30 and FIG. 5 shows a top side view of the dual platform 30. FIG. 4 shows supporting ribs 46 and 57 that extend from the central tube to the outer rim 56 to support the top surface 49 and 59. The bottom 68 of the central tube is flat with the bottom ribs 47 and the outer surface of the lower step. The horizontal stud 63 is shown extending through the central pipe with ears 61. The securing hole 67 is visible for securing the tightening strap (not shown in these figures) that extends out of both sides of the pipe. The stud 63 allows for securing a strap to the sides and then around a power pole. There is an oval shaped hole 65 in the upright pipe 62 to place a hand line hook into the hole 65 to send the dual platform 30 up to the worker. These figures show the mounted rub/friction pads 48, 58 that are mounted to the curved portion of each step where the steps contact a pole. Mounting is with bolts, 44, 45, 54, 55 screws, rivets or similar fastening means. The top 49, 59 of the platforms 40 and 50 are shown with a texture to reduce a potential for a lineman from slipping off the platform top surfaces.

Figure 6:
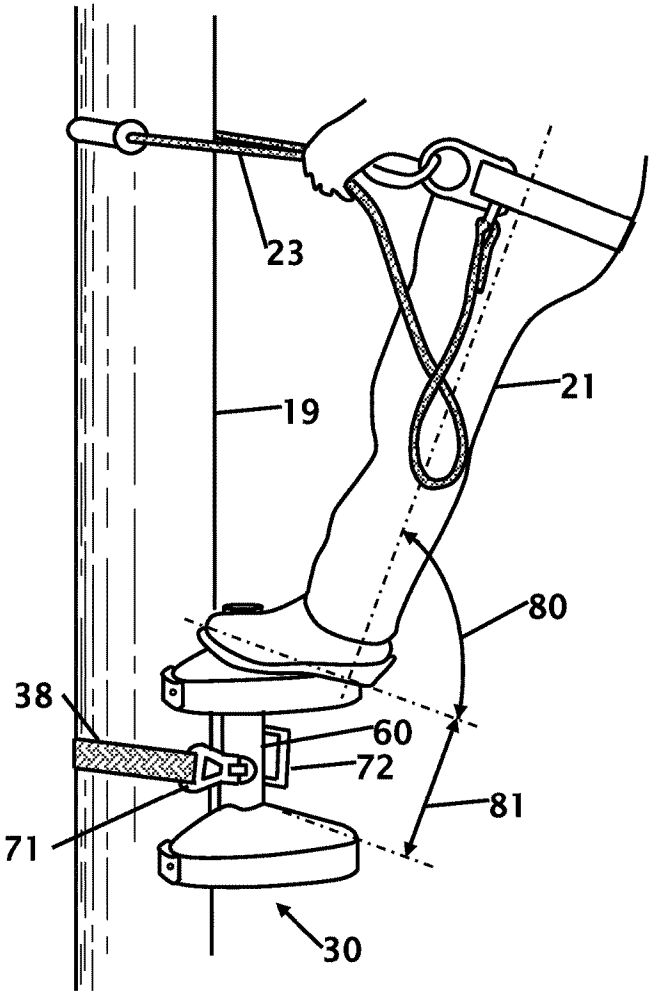
FIG. 6 shows a side view of two dual platforms on a composite power pole being used.

FIG. 6 shows a side view of two dual platforms 30 on a composite power pole 19 being used. The user 21 would first ascend the pole 19, structure or tree that is to be climbed, once the desired location is reached, the hand line 23 is secured to the pole, and the "2 Step" 30 is sent up to the worker or workers. If the user is alone a drop line can be used to pull the device up to the user. They would position it where it would work best for them. Approximately 4 feet below where the work is to take place, then take the 2" ratchet strap 38 around the pole 19 and attach it back onto the buckle 71 on the device, then tighten the ratchet strap 72, then disconnect the hand line and proceed to climb past and up onto the lower level. The strap 38 is held onto the 2 step with ⅜" and a ½" bolt, that is bolted to a solid piece that goes thru the center of the pipe that the 2 platforms are welded too.

If they needed to reach something a little higher up on the pole 19 simply step up onto the upper level and work from there. The distance 81 between the 2 levels are approximately 12 inches apart to be about the same spacing as the rungs on a ladder, so relocating from the lower level to the upper level is done with ease and without having to look. While 12 inches is indicated, a step of 8 inches to 18 inches is contemplated. The angle of the top surfaces of the steps approximates a neutral angle 80 of 90 degrees for the lineman 21 to reduce fatigue while standing on either level of the platform 30 for an extended period of time. The angle of the platforms to the horizon is approximately 20 degrees, but an angle between 15 degrees to 25 degrees is contemplated. This translates to an angle of the step to the central pole of approximately 110 or an angle between 105 and 115 degrees. The outer rim of the platform is created in a spline to maintain the angle regardless of where the operator stands on either platform.

Figure 7:
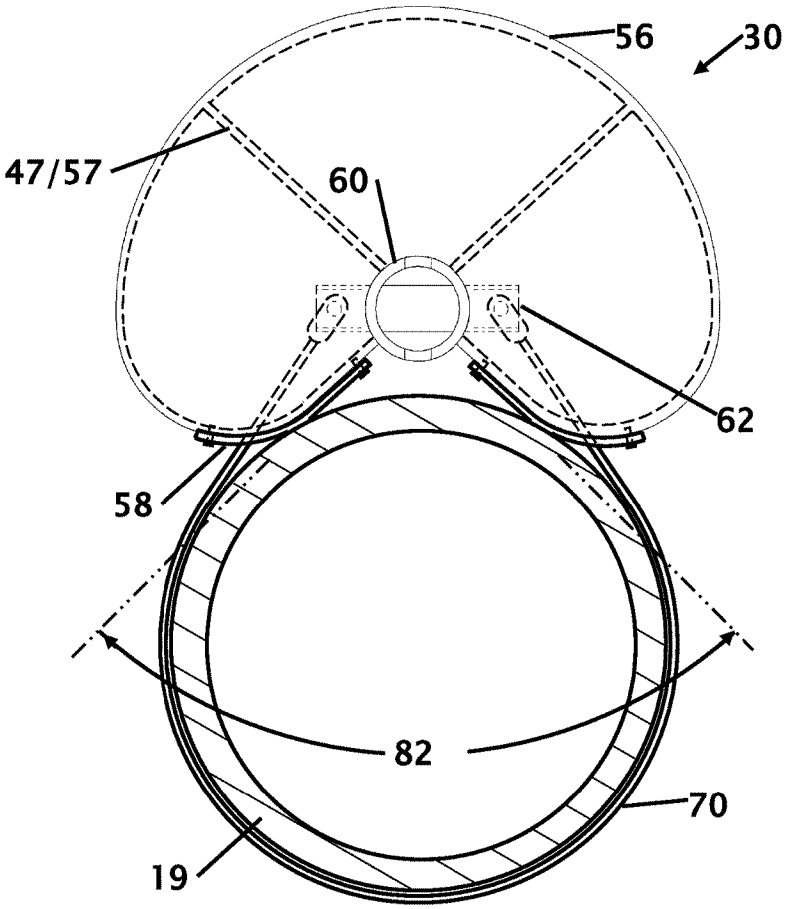
FIG. 7 shows a top cross-sectional view of the dual platform mounted to a composite power pole.

FIG. 7 shows a top cross-sectional view of the dual platform 30 mounted to a composite power pole 19. This figure shows the securing strap 70 around the pole 19 connected to an ear 62 of the securing bolt. The central pipe 60 shows the ribs 47 and 57 extending from the central pipe 60 to the outer rim 56. This figure show the mounted rub/friction pads 58 that are mounted to the curved portion of each step where the steps contact a pole. The steps wrap around the central pole by about 270 degrees, but the wrap angle can range from 181 to 300 degrees. The wrap angle increases the area around the pole where an operator can stand. This creates an essentially 90 degrees wrap around the pole 19 and four dual platforms provides a 360-degree platform around the pole.

Improvements on Pre-Existing Prior Art

It is much easier to install and remove. It is easier and safer to get on and off of. It is ergonomically designed for greater comfort while in use. It has 2 or possibly more levels to work from without relocating the device. A Baker Board has only one level and is 3-4 times as heavy and is harder to mount and awkward to work from.

Other Uses or Applications for this Dual Platform

It can be used on telephone poles, it can be used to splice phone lines, or Cable TV lines, on composite, wood, steel, or concrete poles where a man lift cannot be used in conjunction with a man lift for example one man on the pole using the stepup and one man in the lift.

Thus, specific embodiments of a dual platform for a composite power pole have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LIST

Not Applicable

The invention claimed is:

1. A dual platform for a composite power pole comprising:

a central pole;

said central pole having a fixed secured lower step and a fixed secured upper step that are secured to said central pole at a fixed distance between said fixed secured lower step and said fixed secured upper step;

a stud extending horizontally through said central pole located midway and between said fixed secured lower step and said fixed secured upper step;

said stud having vertical holes on each end, said stud extending through said central pole whereby said holes are accessible from each side of said central pole;

a securing strap that extends to said holes on each side of said stud wherein said strap is configured to extend around said composite power pole to secure said dual platform thereon;

said central pole extends above said fixed secured upper step and includes at least one upper hole;

said fixed secured upper step and said fixed secured lower step slope downward from said central pole to an outer edge of said upper step and said fixed secured lower step whereby said steps are higher near said central pole and said fixed secured upper step and said fixed secured lower step are fixed at an angle from being perpendicular to said central pole;

at least one of said fixed secured upper step or said fixed secured lower step has a supporting rib extending from said central pole and around said at least one step, and said supporting rib extends from one vertical side of said central pole to an opposing vertical side of said central pole.

2. The dual platform for a composite power pole according to claim 1, further includes a ratchet strap.

3. The dual platform for a composite power pole according to claim 2, wherein said ratchet strap is made from Nylon.

4. The dual platform for a composite power pole according to claim 2, wherein said ratchet strap is 2 inches wide.

5. The dual platform for a composite power pole according to claim 1, wherein said fixed secured lower step is angled from perpendicular with respect to said central pole at an angle between 105 and 115degrees.

6. The dual platform for a composite power pole according to claim 1, wherein said fixed secured upper step is angled from perpendicular with respect to said central pole at an angle between 105 and 115 degrees.

7. The dual platform for a composite power pole according to claim 1, wherein said dual platform is made from metal.

8. The dual platform for a composite power pole according to claim 7, wherein said metal is a metal selected from the group consisting of steel, stainless steel, chrome moly, aluminum, bronze and copper.

9. The dual platform for a composite power pole according to claim 1, wherein said dual platform is made from plastic or fiberglass.

10. The dual platform for a composite power pole according to claim 1, wherein said at least one upper hole is oval being configured to accept a hand line.

11. The dual platform for a composite power pole according to claim 1, further includes at least one pad on an outer curved portion of said supporting rib on at least an exterior portion of said fixed secured lower step or said fixed secured upper step.

12. The dual platform for a composite power pole according to claim 11, wherein said at least one pad is secured to said fixed secured lower step or said fixed secured upper step with a fastener.

13. The dual platform for a composite power pole according to claim 1, wherein a top of said fixed secured lower step and or said upper step is textured.

14. The dual platform for a composite power pole according to claim 1, wherein said dual platform is nestable with a second dual platform.

15. The dual platform for a composite power pole according to claim 14, wherein said nesting is on opposite sides of an upright member.

16. The dual platform for a composite power pole according to claim 1, wherein said dual platform conforms to an upright pole.

17. The dual platform for a composite power pole according to claim 16, wherein said upright pole is a wood pole, composite pole, power pole, utility pole or telephone pole.

18. The dual platform for a composite power pole according to claim 1, wherein each of said fixed secured lower step and said fixed secured upper step wraps around said central pole between 181 degrees and 300 degrees.

19. The dual platform for a composite power pole according to claim 1, wherein one or more additional dual platforms are secured to an upright member to make a circumferential platform around said upright member.

20. The dual platform for a composite power pole according to claim 1, wherein one or more additional dual platforms are secured to an upright pole to make a circumferential staircase around said upright member.

* * * * *